US009809047B2

(12) United States Patent
Whaley et al.

(10) Patent No.: US 9,809,047 B2
(45) Date of Patent: Nov. 7, 2017

(54) RING LOCK GUARD FOR A RING BINDER

(71) Applicant: U.S. Ring Binder, L.P., St. Louis, MO (US)

(72) Inventors: Paul Whaley, Herculaneum, MO (US); Christopher Whaley, Herculaneum, MO (US)

(73) Assignee: U.S. Ring Binder, L.P., St. Louis, MO (US)

( * ) Notice: Subject to any disclaimer, the term of this patent is extended or adjusted under 35 U.S.C. 154(b) by 942 days.

(21) Appl. No.: 14/177,742

(22) Filed: Feb. 11, 2014

(65) Prior Publication Data

US 2014/0234013 A1 Aug. 21, 2014

Related U.S. Application Data

(60) Provisional application No. 61/765,965, filed on Feb. 18, 2013, provisional application No. 61/783,534, filed on Mar. 14, 2013.

(51) Int. Cl.
*B42F 13/20* (2006.01)
*B42F 3/00* (2006.01)
(Continued)

(52) U.S. Cl.
CPC ..... *B42F 13/40* (2013.01); *B42F 13/26* (2013.01); *B42F 13/36* (2013.01)

(58) Field of Classification Search
CPC ..... B42F 13/40; B42F 13/26; B42F 13/36
(Continued)

(56) References Cited

U.S. PATENT DOCUMENTS 794,733 A 7/1905 Neuner
805,575 A 11/1905 Morden
(Continued)

FOREIGN PATENT DOCUMENTS

DE 8700504 U1 2/1987
FR 702944 A * 4/1931 ..... B42F 3/04
(Continued)

OTHER PUBLICATIONS

Movie Prop Sites, LLC, South Australia, "PVC Mail & WETA/TENZAN possible solution found?", RPF Feed, Jan. 5, 2008, 6 pages.

(Continued)

*Primary Examiner* — Charles A Fox
*Assistant Examiner* — Justin V Lewis
(74) *Attorney, Agent, or Firm* — Polster Lieder

(57) ABSTRACT

A ring metal (M) installed in a binder (B) stores punched sheets of paper and the like. The ring metal includes binder rings (R) mounted on movable frames (F) to which one end of each ring half is attached. The frames are movable relative to each other to open and close the rings. A ring guard (10) is removably installable over a portion of each ring half, when the binder ring is closed, to securely encompass rings halves (12, 14) forming the ring. The guard encloses the junction (J) where outer ends of the ring halves meet when the rings are closed and prevents a gap from opening between the ring halves if the binder is subjected to a force which would otherwise cause a gap to form between the ring halves and paper stored in the binder to spill out or be damaged.

5 Claims, 20 Drawing Sheets

(51) Int. Cl.

| | |
|---|---|
| ***B42F 13/02*** | (2006.01) |
| ***B42F 13/06*** | (2006.01) |
| ***B42F 13/08*** | (2006.01) |
| ***B42F 3/02*** | (2006.01) |
| ***B42F 13/40*** | (2006.01) |
| ***B42F 13/26*** | (2006.01) |
| ***B42F 13/36*** | (2006.01) |

(58) Field of Classification Search
USPC ..... 402/8, 9, 10, 12, 15, 16, 19, 20, 21, 22, 402/31, 39
See application file for complete search history.

(56) References Cited

U.S. PATENT DOCUMENTS

| | | | | |
|---|---|---|---|---|
| 2,202,567 | A | 5/1940 | Spinner | |
| 2,894,425 | A | 7/1959 | Rapata | |
| 4,165,001 | A | 8/1979 | Cooper | |
| 2003/0103796 | A1 | 6/2003 | To et al. | |
| 2004/0018041 | A1* | 1/2004 | Amdahl | B42B 5/10 402/26 |
| 2010/0316435 | A1* | 12/2010 | Gilbert | B42F 13/26 402/39 |

FOREIGN PATENT DOCUMENTS

| | | | | |
|---|---|---|---|---|
| FR | 733699 | A * | 10/1932 | B42F 3/04 |
| GB | 1277939 | A | 6/1972 | |
| WO | 2010111982 | A1 | 10/2010 | |

OTHER PUBLICATIONS

International Search Report for PCT application PCT/US2014/023061 dated Aug. 28, 2014.
Written Opinion for PCT application PCT/US2014/023061 dated Aug. 28, 2014.

* cited by examiner

RING LOCK GUARD FOR A RING BINDER

CROSS REFERENCE TO RELATED APPLICATIONS

This application is based upon, and claims the benefit of, U.S. provisional patent application 61/765,965 filed Feb. 18, 2013 and U.S. provisional patent application 61/783,534 filed Mar. 14, 2013, hereby incorporated by reference.

STATEMENT REGARDING FEDERALLY SPONSORED RESEARCH OR DEVELOPMENT

N/A

BACKGROUND OF THE INVENTION

This invention relates to loose leaf ring metals or binders; and, more particularly, to a ring lock or ring guard removably attachable to a binder ring to provide a "gap free" binder ring which cannot inadvertently be opened thereby to prevent damage to, or the loss of, material stored in the binder.

It has long been a problem with loose leaf binders holding store hole punched sheets of paper and the like that the binder rings by which the material is stored in the binder can inadvertently be opened. Typically, if a binder is dropped or knocked off a table or other support, when it hits the ground or floor, the binder rings "pop" open and material stored in the binder can spill out. Or, the rings partially open and then do not properly reclose. Oftentimes when this latter occurs, the stored paper snags between the outer ends of the two ring halves forming the binder ring and is torn or otherwise damaged.

A number of attempts have been made to solve this problem. Recent attempts have been made to produce either 1) a "gap free" ring metal construction, or 2) a locking ring metal. A gap free design is one in which the outer, mating ends of binder ring halves are constructed so that even if the binder is subjected to a sudden opening force, the ends of the rings do not fully separate from each other and no gap is formed between them. A locking ring metal is one in which, when the binder is closed, the binder rings are locked in place and secured by some mechanism so the rings cannot be opened unless a prescribed sequence of events occur.

While the various gap free and locking ring metal constructions are to different degrees successful, there are still other approaches by which materials stored in a binder can be securely locked in place and so prevent loss of, or damage to, stored material.

BRIEF SUMMARY OF THE INVENTION

The present disclosure is directed to a ring lock or ring guard for installation on one or more binder rings of a ring metal. When installed, the ring guard retains the ring(s) in a closed, no gap or "gap free" configuration. This condition persists even if the mating ends of the binder ring segments momentarily move apart due to some force being applied to the binder such as when it falls from a height or something slams into the binder.

The ring metal is installed in a binder holding hole punched sheets of paper and the like and each ring is formed by a pair of complementary shaped binder ring halves one end of each of which is attached to a movable frame to open and close the rings. The ring guard is removably installable over at least a portion of each ring half when the binder ring is closed to securely encompass the rings halves. This includes the junction between them where outer ends of the respective ring halves meet when the binder ring is closed. When in place, the ring guard prevents a gap from opening between the ring halves when the binder is subjected to a force which would otherwise cause a gap to form and the paper or other contents stored in the binder to spill out or be damaged.

In one embodiment, the ring guard comprises an arcuate segment having a longitudinal channel formed in it. The length of the segment is such that, when installed, it fits over a substantial portion of each ring half and overlays the outer, mating ends of the ring halves; even if the ring guard extends over more of one ring half than the other. The ring guard is shaped to conform to the contour of a closed binder ring, regardless of whether the contour is circular, oval, or other (e.g., D-shaped).

In one embodiment the ring guard fits over and encompasses the topside of a closed binder ring. In another embodiment, the guard fits over and encompasses the underside of the closed binder ring. In yet another embodiment, the ring guard fits about a side of the closed binder ring. In each embodiment, the ring guard covers substantially more than half the outer portion of each ring half so the ring guard cannot be inadvertently dislodged.

The ring guard is of a unitary, one-piece construction that snuggly fits onto a binder ring. To lock a binder ring closed, a ring guard is fitted over each binder ring half, when the ring is closed. Each ring guard fits tightly against the outer surface of the ring halves effectively preventing them from being pulled apart.

The ring guard is readily attached to binders which are shipped or carted from one place to another so no stored materials are lost or damaged during transit. The ring guard is then easily removed so the contents are readily accessible at the using site.

The ring guard has a smooth outer contour; or it can have a shaped outer contour including ridges or hollows, or it can have a polygonal outer contour. Other contours are also available. The ring guard is also available in a variety of colors allowing for color coding schemes with respect to the stored contents in a binder.

The ring guard is available in strip packs by which a number of ring guards are formed in a tear apart, side-by-side arrangement. When a user needs a ring guard, they pull one apart from one end of the strip.

The ring guard is provided with the binder at a point-of-sale either already attached to the binder's rings, or in a separate package (which may include extra ring guards in the event one is lost or damaged) attached to the binder, or in a package which is sold separately.

In another embodiment, a tab is formed together with the ring guard. The tab is for assisting a user in fitting a ring guard onto a binder ring, or taken it off of the ring.

In yet another embodiment, the ring guard comprises two-halves which fit together to form a completed ring guard which is then installed on a binder ring.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

FIGS. 3A-3C are elevation views of the types of rings on which the ring guard is used wherein FIG. 3A is a generally circular ring, FIG. 3B a generally oval shaped ring, and FIG. 3C a D shaped ring;

FIGS. 13A-13C illustrate another embodiment of the ring guard in which FIG. 13A is a plan view of the ring guard, FIG. 13B an elevation view, and FIG. 13C and installed view;

Corresponding reference characters indicate corresponding parts throughout the several views of the drawings.

DETAILED DESCRIPTION OF INVENTION

Figure 1:
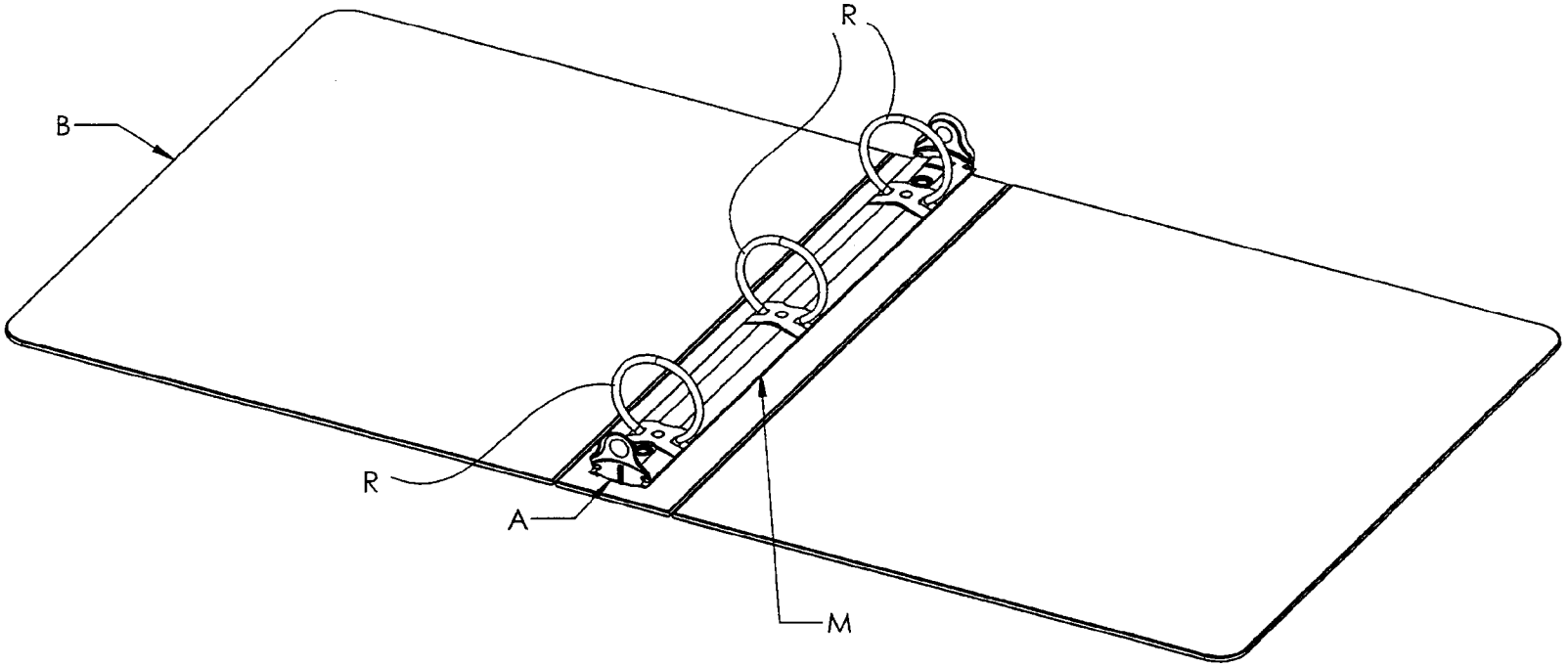
FIG. 1 is a perspective of a conventional ring binder on which a ring guard of the present invention is used.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a ring metal M installed in a binder B is for holding and storing hole punched sheets of paper or other loose leaf materials. As shown in FIG. 1, a ring metal includes at least one, and typically two or three rings R. As is well-known in the art, each ring R is comprised of two complementary ring halves R1 and R2.

Figure 3A:
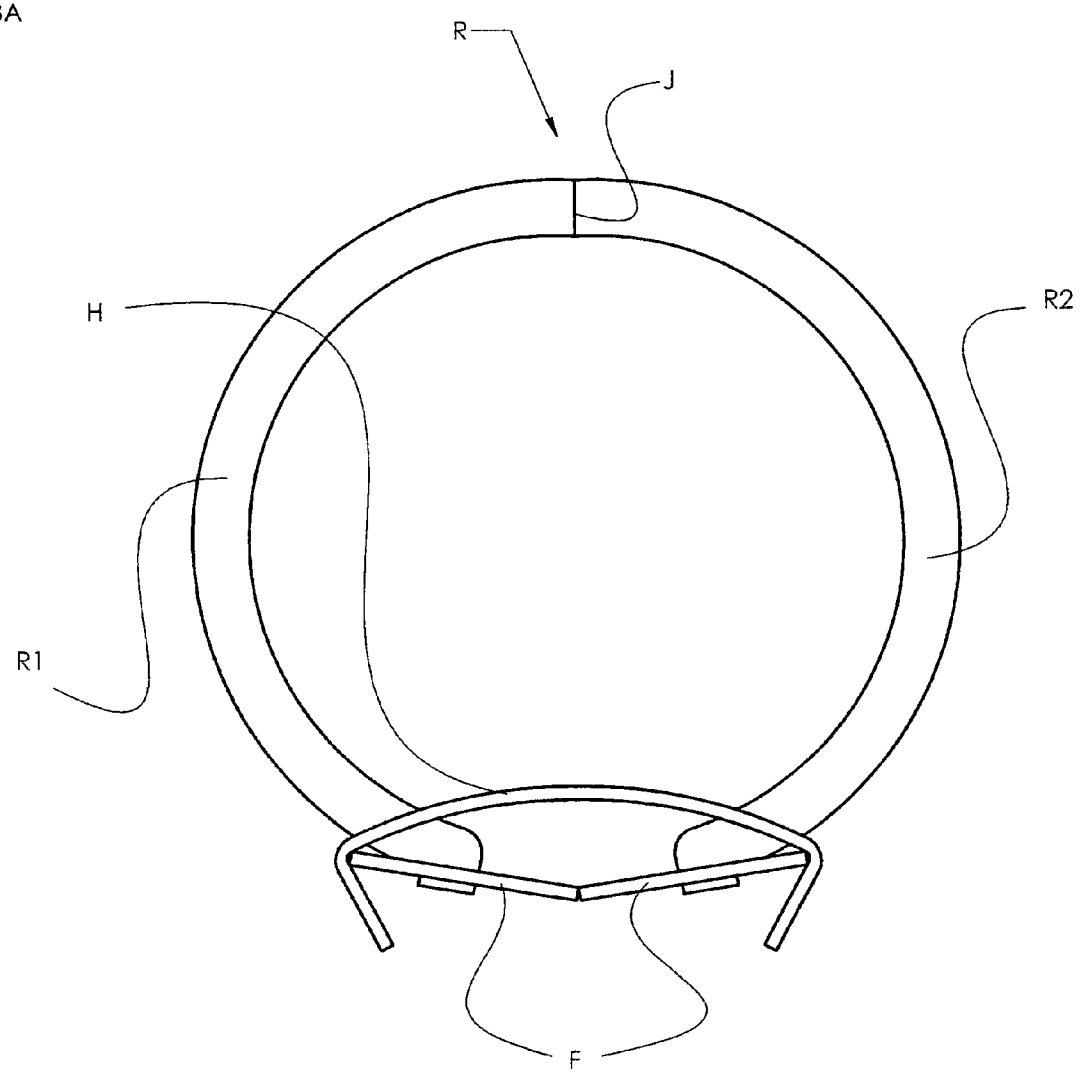
Figure 3B:
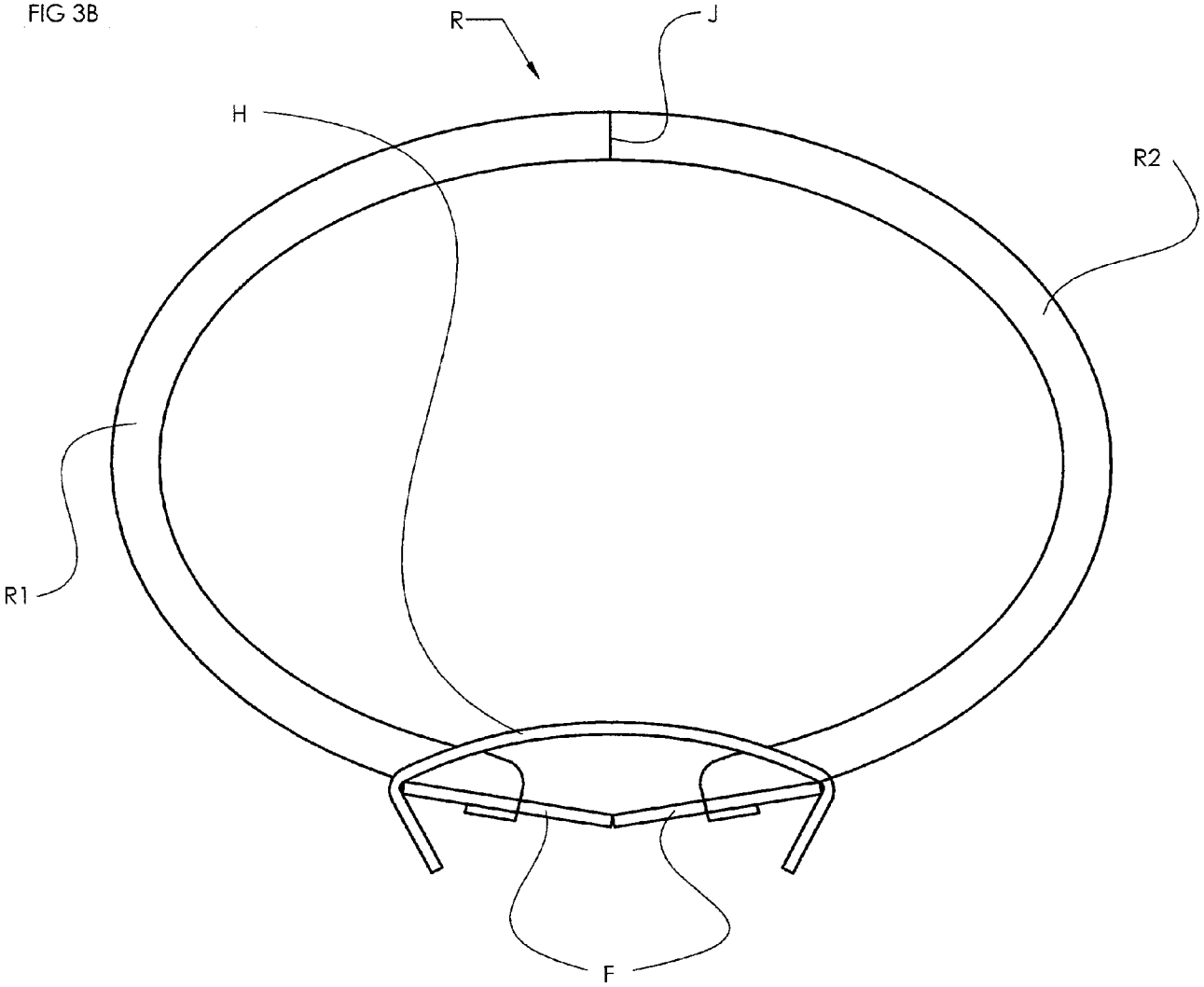
Figure 3C:
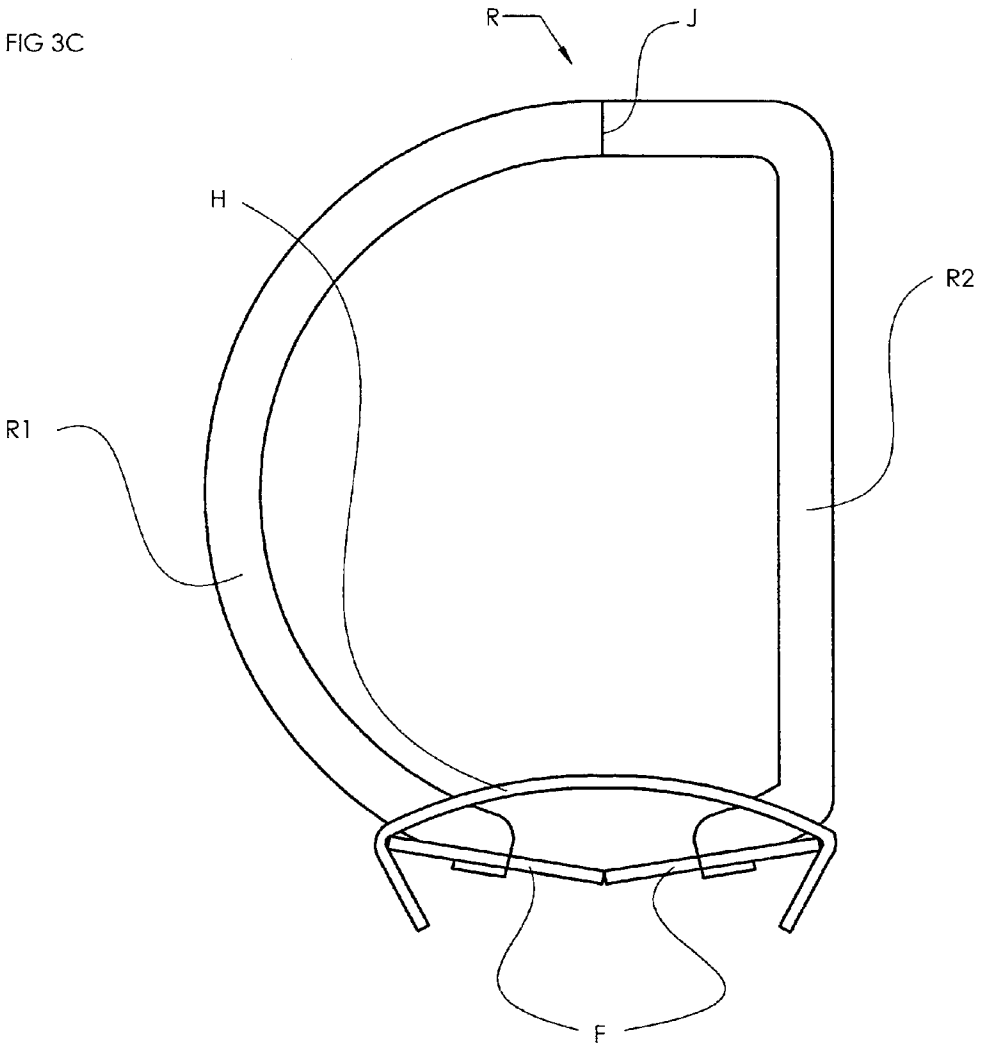
Figure 4A:
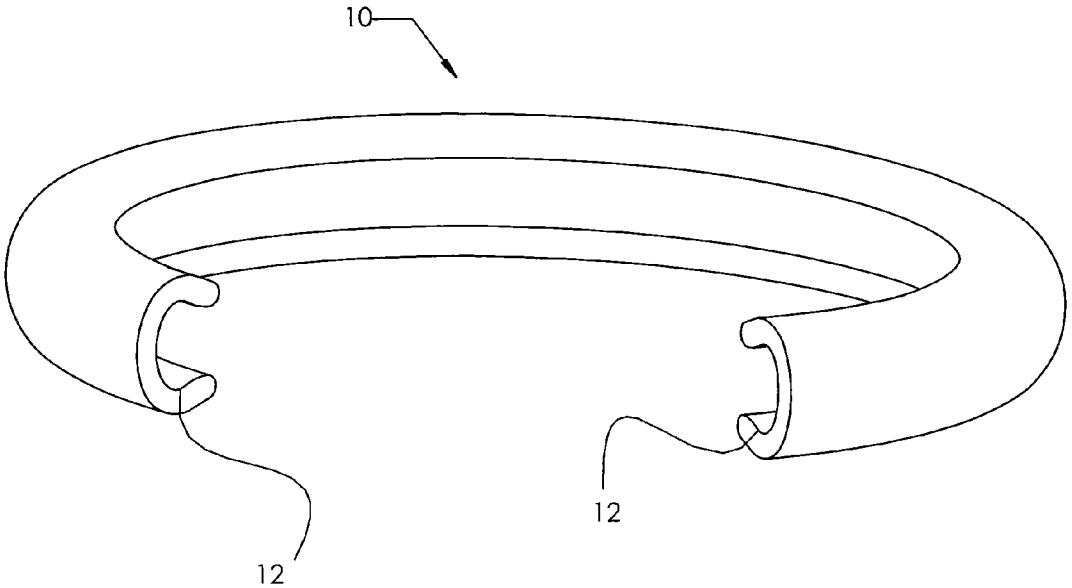
FIG. 4A is a perspective view one embodiment of the ring guard.
Figure 4C:
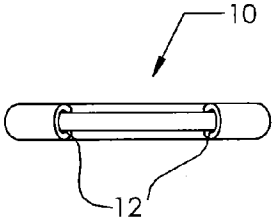
FIGS. 4B and 4C respective top and bottom plan views of the ring guard, FIG. 4D an elevation view of the ring guard, and FIG. 4E an elevation view, in section, of the ring guard.
Figure 4B:
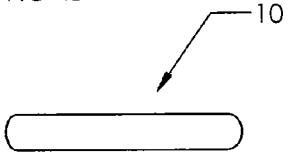
Figure 4D:
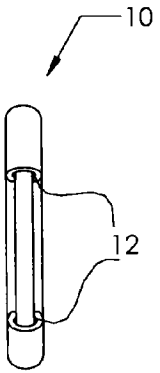
Figure 4E:
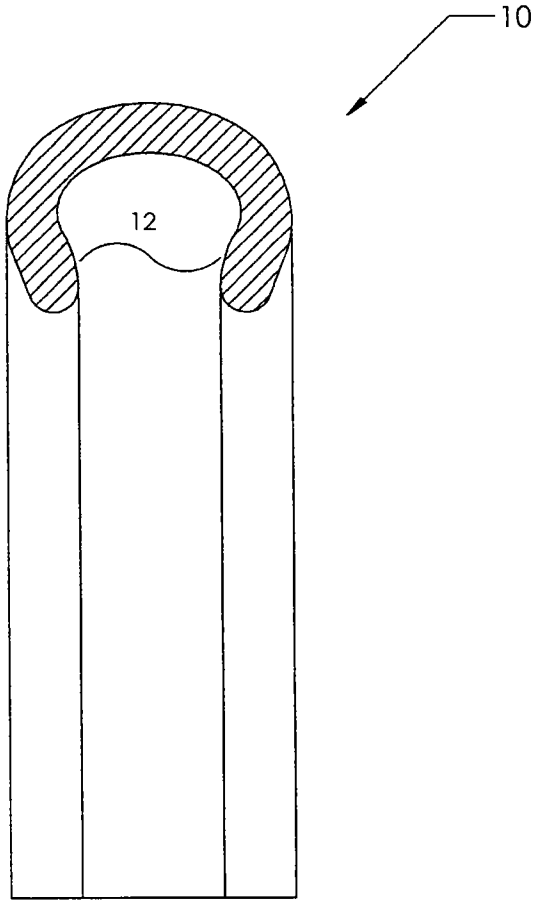
Figure 5A:
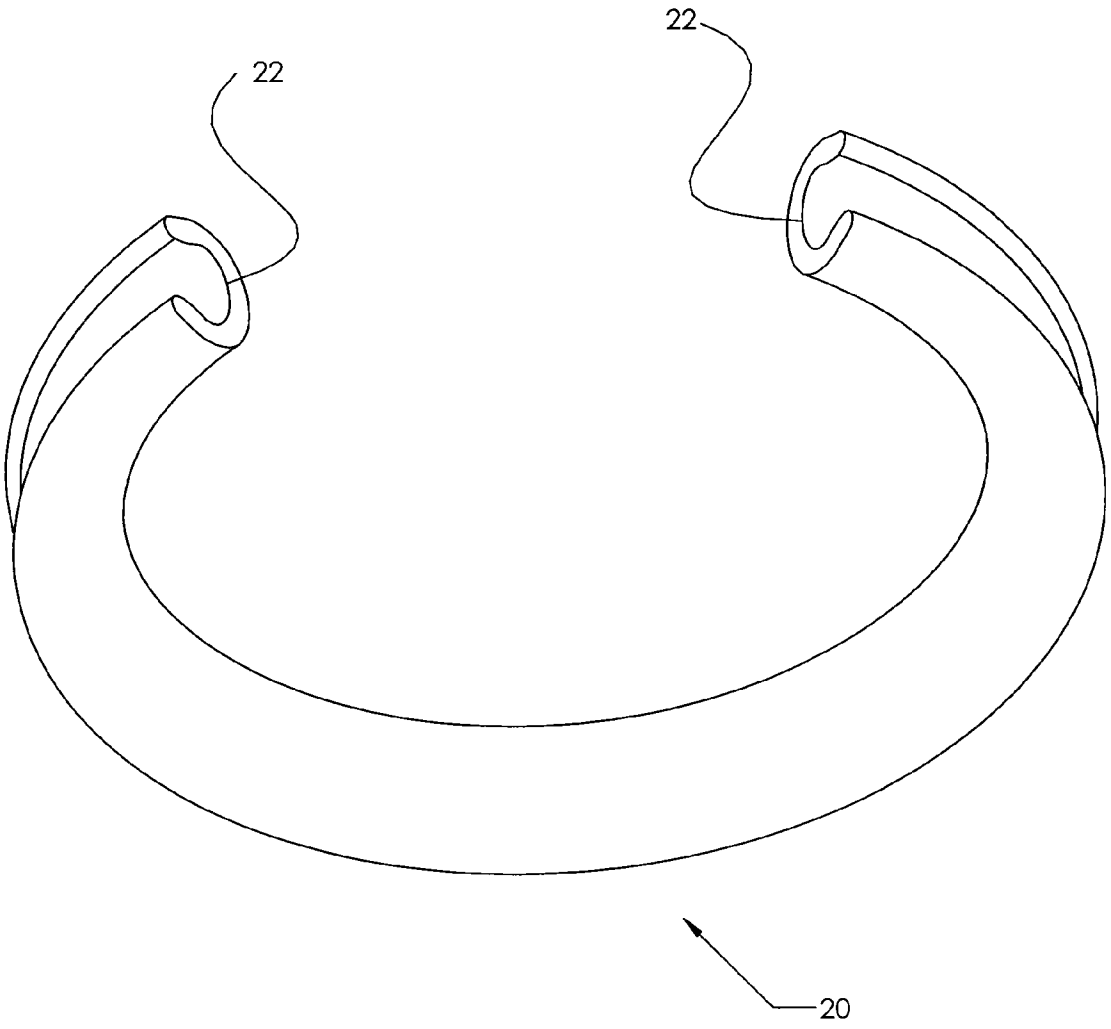
FIG. 5A is a perspective view a second embodiment of the ring guard.
Figure 5C:
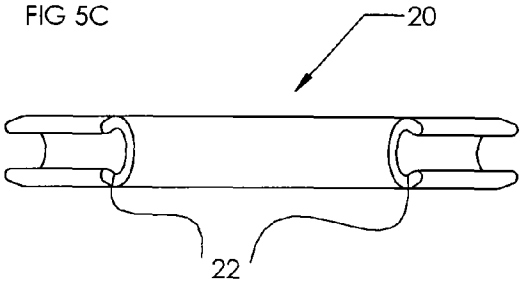
FIGS. 5B and 5C respective top and bottom plan views of the ring guard, FIG. 5D an elevation view of the ring guard, and FIG. 5E an elevation view, in section, of the ring guard.
Figure 5E:
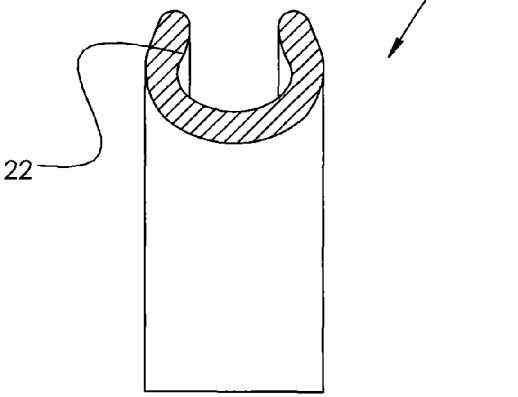
Figure 5B:
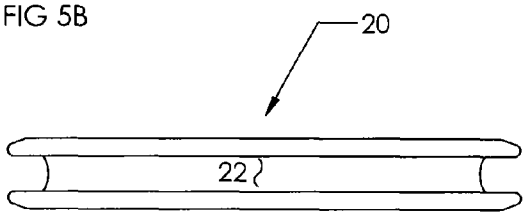
Figure 5D:
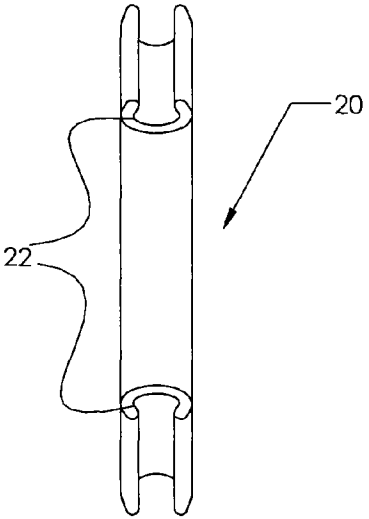

Referring to FIGS. 3A-3C, binder rings are available in a variety of shapes. FIG. 3A illustrates a generally round shaped ring; FIG. 3B a generally oval shaped ring; and, FIG. 3C illustrates a ring generally referred to as a "D" ring in accordance with its D-shaped profile. As noted, each type ring is comprised of a ring half R1, R2 one end of each of which is mounted to a movable frame F installed in a housing H of the ring metal. The outer, mating ends of each ring half meet at a junction J when the ring is closed. The construction of the mating ends is one of a variety of shapes or contours which form no part of the invention. Movement of the frames to open and close rings R is controlled by an actuator A; although it will be understood by those skilled in the art that some ring metal constructions do not employ an actuator. Rather, the binder rings are manually opened and closed. Typically, actuator A comprises a lever or the like installed at one end of ring metal M and whose movement produces rotation of frames F to open and close the rings.

Figure 2A:
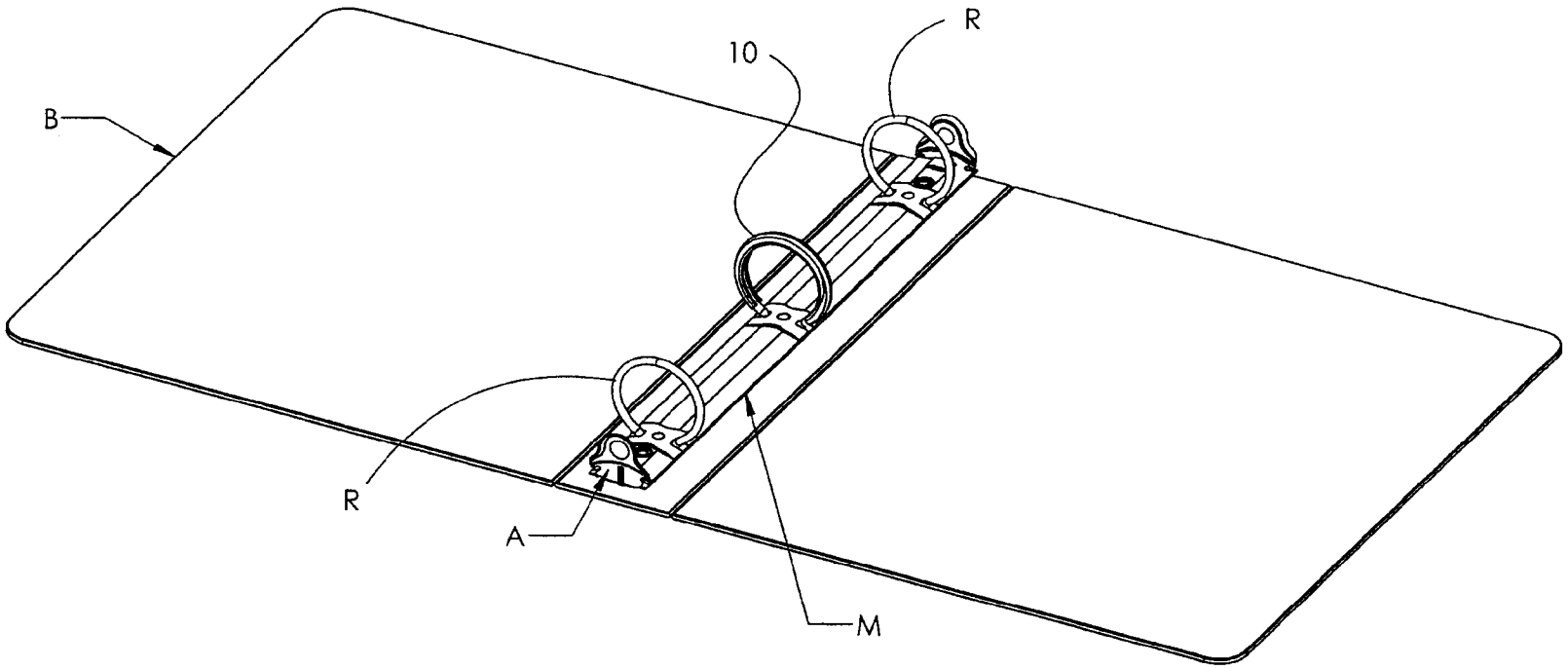
FIG. 2A is a view similar to FIG. 1 in which a ring guard is installed on one of the binder rings.
Figure 2B:
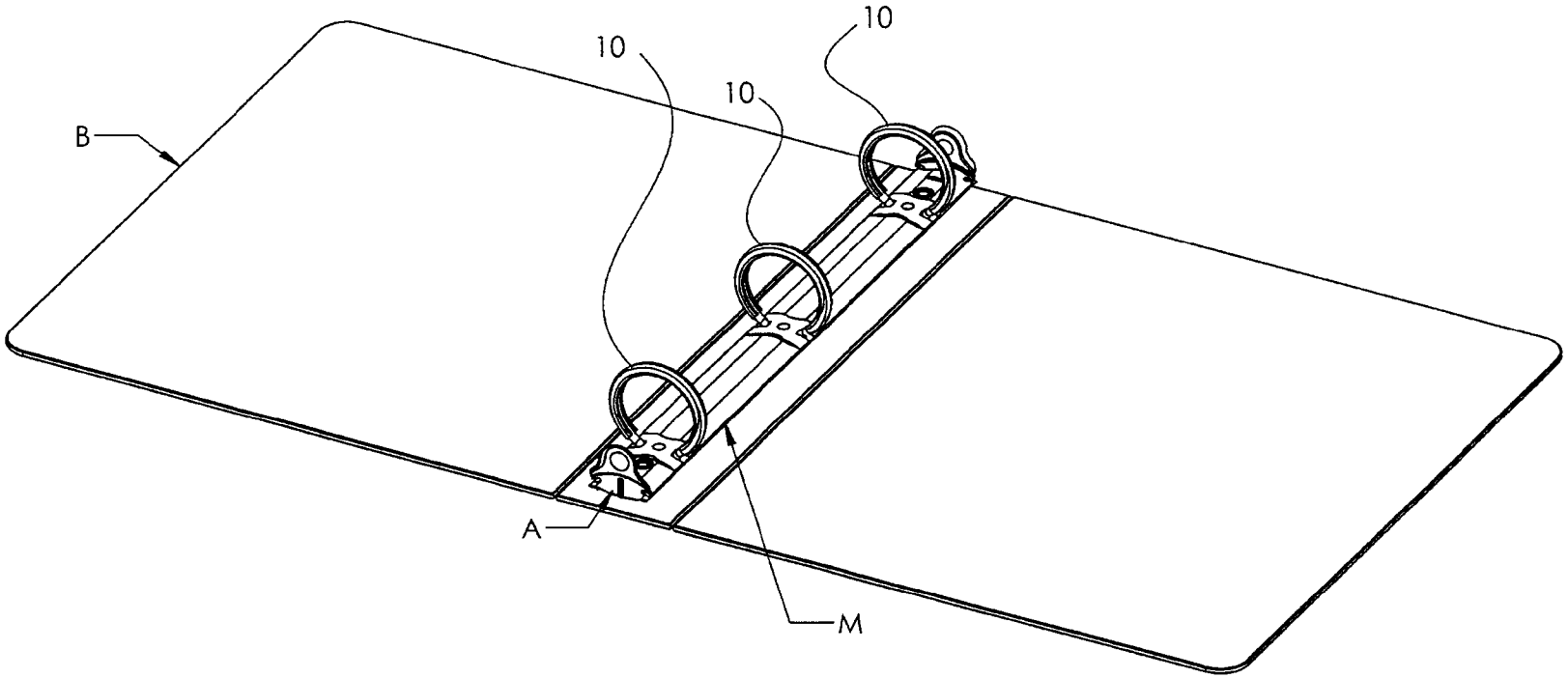
FIG. 2B is another view similar to FIG. 1 in which a ring guard is installed on all the binder rings.
Figure 2C:
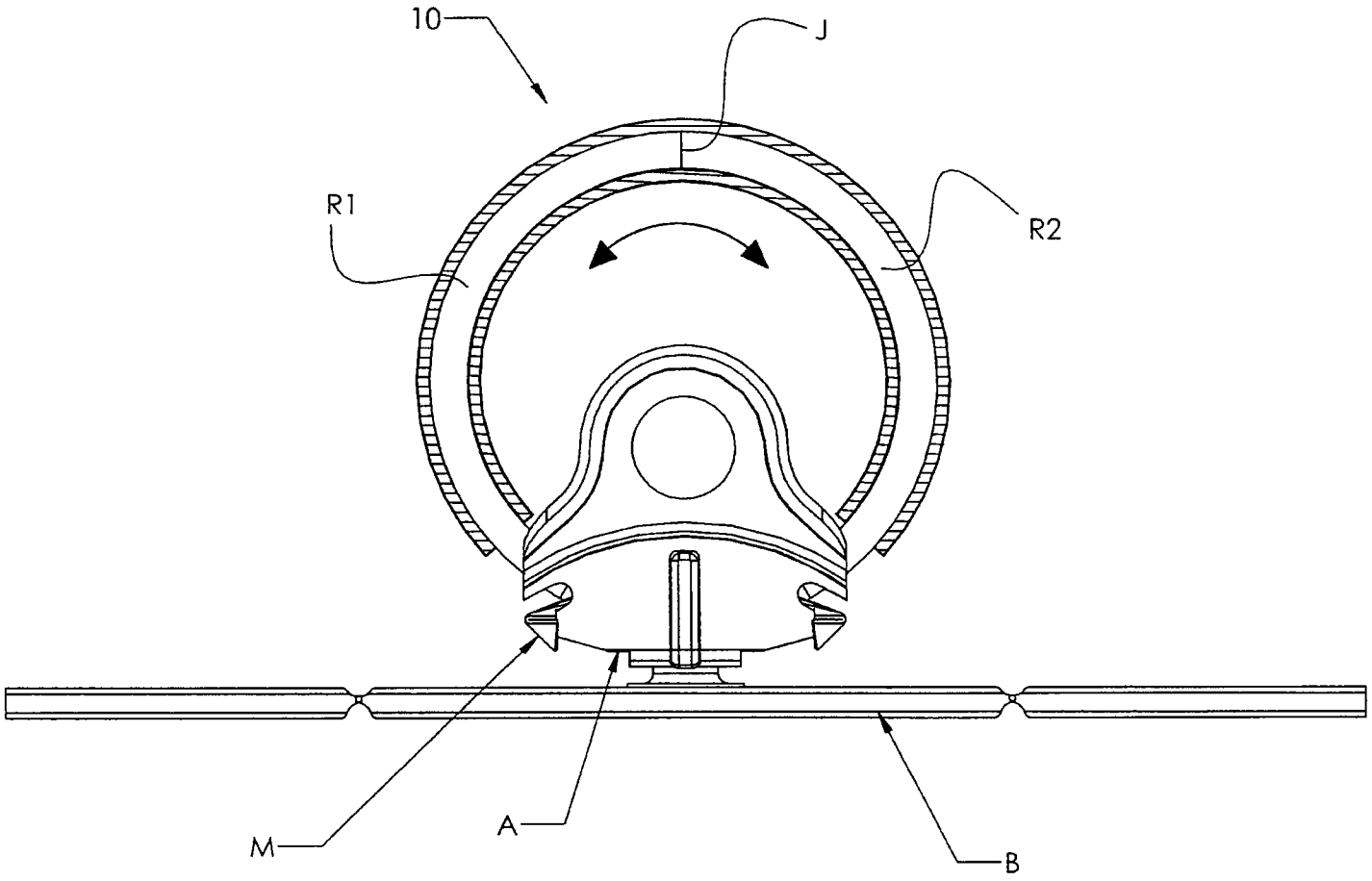
FIG. 2C is a sectioned view of a ring guard as installed on a binder ring.

A ring guard 10 of the present invention is removably installable over at least one of the binder rings R as shown in FIG. 2A; or over all of the binder rings as shown in FIG. 2B. Referring to FIG. 2C, ring guard 10 snuggly fits over a portion of each ring half R1, R2 when the binder ring is closed. Ring guard 10, when in place, now securely encompasses a substantial portion of both rings halves including junction J where the outer ends of the respective ring halves meet. By so encompassing junction J and significant portions of the ring halves R1, R2 on both sides of the junction where the outer ends of the respective ring halves meet when the binder ring is closed, any gap, however big, which might otherwise open between the ring halves when binder B is subjected to a force that might cause a gap to form is now prevented. Ring guard 10 thereby insures that any paper or other material stored in binder B will not spill out or be damaged.

Referring to FIGS. 4A-4E, ring guard 10 has a generally rounded shape the curvature of which corresponds to that of the upper surface of a binder ring. The ring guard is also of a one-piece construction and is preferably formed of a high impact molded plastic material. The size and shape of ring guard 10 is such that it allows the ring guard to be readily installed on a binder ring. However, once in place, ring guard 10 grips about the ring so as not to be dislodged when the binder is dropped or struck with a strong force. The overall length of ring guard 10 is such that, when fitted over ring R, as shown in FIG. 2C, the ring guard cannot be so installed as to expose the junction J between the outer ends of ring halves R1, R2. Rather, the ring guard overlays more than half the arcuate length of each ring half. Accordingly, the ring guard is usually installed so that if encompasses the same portion of each ring half with the midpoint of the ring guard overlying junction J. Subsequently, if the ring guard gravitates more to one side of one ring half, as indicated by the arrows in FIG. 2C, there is still a sufficient portion of the guard fitting over the other ring half that a gap will not be created between the halves if ring metal M is subjected to a force that previously would cause a gap to open.

The outer circumference of ring guard 10 is greater than 180° so that the ring guard covers more than one-half the outer circumference of each ring half. Typically, the outer circumference of the ring guard is, preferably, between 240°-270° so to cover between ⅔-¾ of the rings' outer circumference. Accordingly, when fitted in place over a binder ring R, the ring guard will not pull away from, or fall off the binder ring during normal usage of the binder in which the ring guard is installed. The ends of the ring guard are tapered so to provide a smooth surface transition between the ring guard and binder ring half. This prevents stored sheets of paper from snagging or tearing on the ring guard.

On the underside of ring guard 10 a longitudinal channel 12 is formed. Channel 12 extends the length of the ring guard. When fitted over a binder ring R, channel 12 allows ring guard 10 to fit snuggly about the sides and top of the ring halves R1, R2 so that the ring guard cannot readily be dislodged. In addition, the snug fit also prevents sliding of the ring guard over the outer surface of the ring halves so there is little, or no, side-to-side movement of the ring guard over the ring. Importantly, if binder B is dropped from a height, or struck by a force, a resulting (usually momentary) separation of the ring halves, which normally will produce a gap between the outer ends of the ring halves, cannot now occur. The result therefore is a "gap free" binder ring in which loss of, or damage to, the binder's contents cannot occur.

Ring guard 10 can, as noted, be fitted over one binder ring R, or over all the binder rings. For this purpose, a ring guard can be fitted onto a ring, or on all the rings, during manufacture of a binder. The binder is then shipped, warehoused, displayed, and sold with the ring guard(s) in place. The purchaser then removes the ring guard(s) when they wish to start storing contents in the binder.

In some instances, a binder is sold with sheets of paper already loaded into the binder. In this situation, the ring guard(s) is/are installed after the paper is loaded but before the binder is packaged and shipped. A similar situation occurs when binders are prepared for business meetings, presentations, seminars, etc. where specially prepared materials are for use by the participants. Now, the materials are collated and placed in a binder. Next, a ring guard is fitted over the binder ring(s) and the binder shipped to the using site with the knowledge that the contents will not be lost or damaged.

Referring to FIGS. 5A-5E, a second embodiment of the ring guard of the present invention is indicated generally 20. Unlike the first embodiment of the ring guard in which the top and side portions of the ring halves fit in channel 12 with the underside of the ring halves remaining exposed, ring guard 20 is oppositely installed. That is, ring guard 20 has a generally rounded shape the curvature of which now corresponds to that of the underside of a binder ring. Ring guard 20 is of a one-piece construction and its size and shape allows it to be readily installed on the underside of the binder ring. Again, once in place, ring guard 20 grips about the ring so as not to be readily dislodged. As with ring guard 10, the overall length of ring guard 20 is such that, when fitted over ring R, the ring guard cannot be so installed as to expose junction J; rather ring guard 20 overlays more than half the arcuate length of each ring half R1, R2. Also as with ring guard 10, ring guard 20 has an outer circumference greater than 180° so to cover more than one-half the outer circumference of each ring half. Again, this outer circumference is preferably between 240°-270°.

On the topside of ring guard 20 is a longitudinal channel 22 that extends the length of the ring guard. When fitted over the underside of a binder ring R, channel 22 allows ring guard 20 to fit snuggly about the bottom and sides of ring halves R1, R2 so the ring guard cannot readily be dislodged. The snug fit again prevents sliding of ring guard 20 over the outer, bottom and side surfaces of the ring halves so there is little, or no, side-to-side movement of the ring guard over the ring.

Figure 6C:
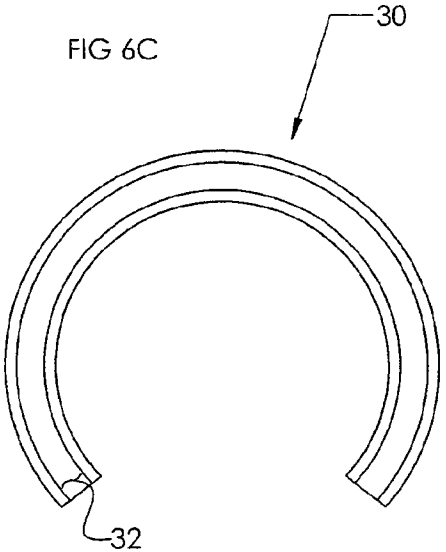
FIGS. 6A-6C illustrate a third embodiment of the ring guard which fits about the side of a ring, FIG. 6A illustrating one side of the binder ring and FIG. 6B the opposite side, and FIG. 6C an elevation view of the ring guard.
Figure 6B:
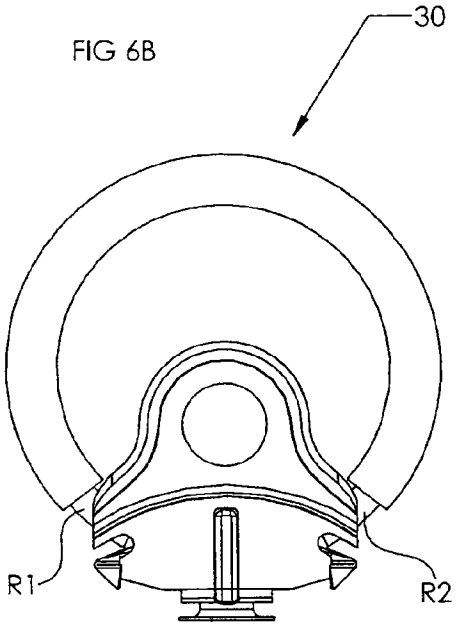
Figure 6A:
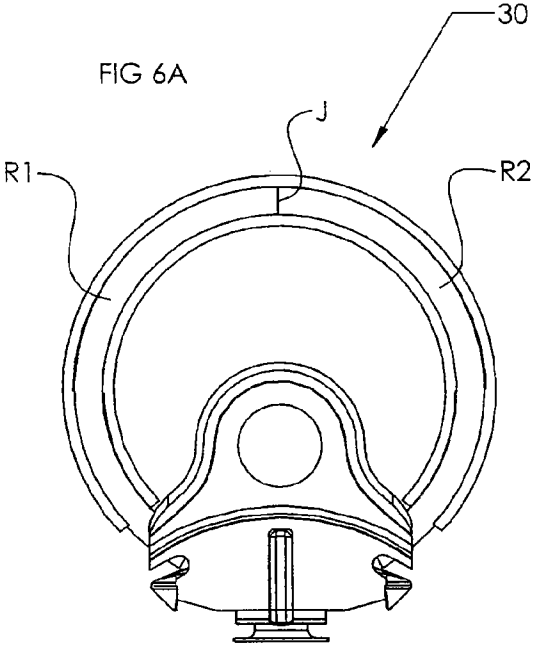

Referring to FIGS. 6A-6C, a third embodiment of the ring guard of the present invention is indicated generally 30. Ring guard 30 differs from the two previously described ring guard embodiments in that it fits about the sides of binder ring rather than over the top or underside of the ring. Ring guard 30 is of a one-piece construction and its size and shape allows it to be readily installed about the side of the binder ring and once in place grip about the ring so as not to be readily dislodged. As with ring guards 10 and 20, the overall length of ring guard 30 is such that, when fitted over ring R, the ring guard cannot be so installed as to expose junction J; but instead overlays more than half the arcuate length of each ring half R1, R2. Ring guard 30 has an outer circumference greater than 180° so to cover more than one-half the outer circumference of each ring half; and, as with the previously described embodiments, this outer circumference is preferably between 240°-270°.

On the inside of ring guard 30 is a longitudinal channel 32 that extends the length of the ring guard. When fitted about the side, top, and underside of a binder ring R, channel 32 allows ring guard 30 to fit snuggly about the ring halves R1, R2 so the ring guard cannot readily be dislodged. As with the other embodiments, the snug fit prevents sliding of ring guard 30 over the outer surfaces of the ring halves so there is little, or no, side-to-side movement of the ring guard over the ring.

Figure 7A:
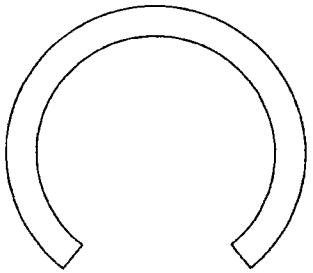
FIGS. 7A-7E illustrate representative different outer contours of a ring guard including smooth (FIG. 7A), lobular (FIG. 7B), polygonal (FIG. 7C), channeled (FIG. 7D), and serrated (FIG. 7E)
Figure 7B:
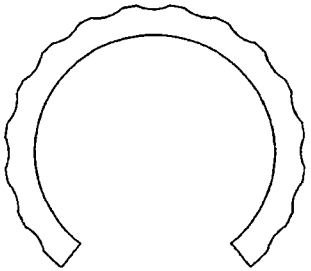
Figure 7C:
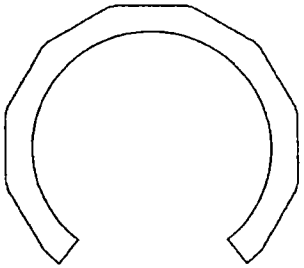
Figure 7D:
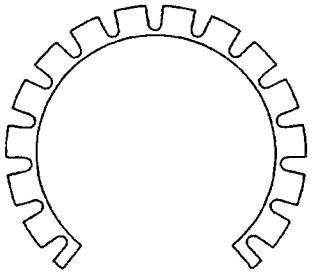
Figure 7E:
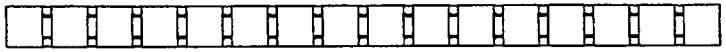

As shown in FIGS. 7A-7E, the outer surface of ring guards 10, 20, and 30 can have of a number of different contours. As shown in FIG. 7A, this contour can be a smooth contour. As shown in FIG. 7B, the outer contour can have a lobular shape formed by a series of rounded projections that extend the length of the ring guard from one side of the ring guard to the other. As shown in FIG. 7C, the outer contour can have a polygonal shape including, for example, square, pentagonal, hexagonal, or octagonal. In FIG. 7D, a series of longitudinally extending channels extend the length of the ring guard along its outer surface. As shown in the top plan view of FIG. 7E, a series of serrations extend laterally across the outer surface of the ring guard. Those skilled in the art will understand that other configurations can also be produced without departing from the scope of the invention.

Figure 8:
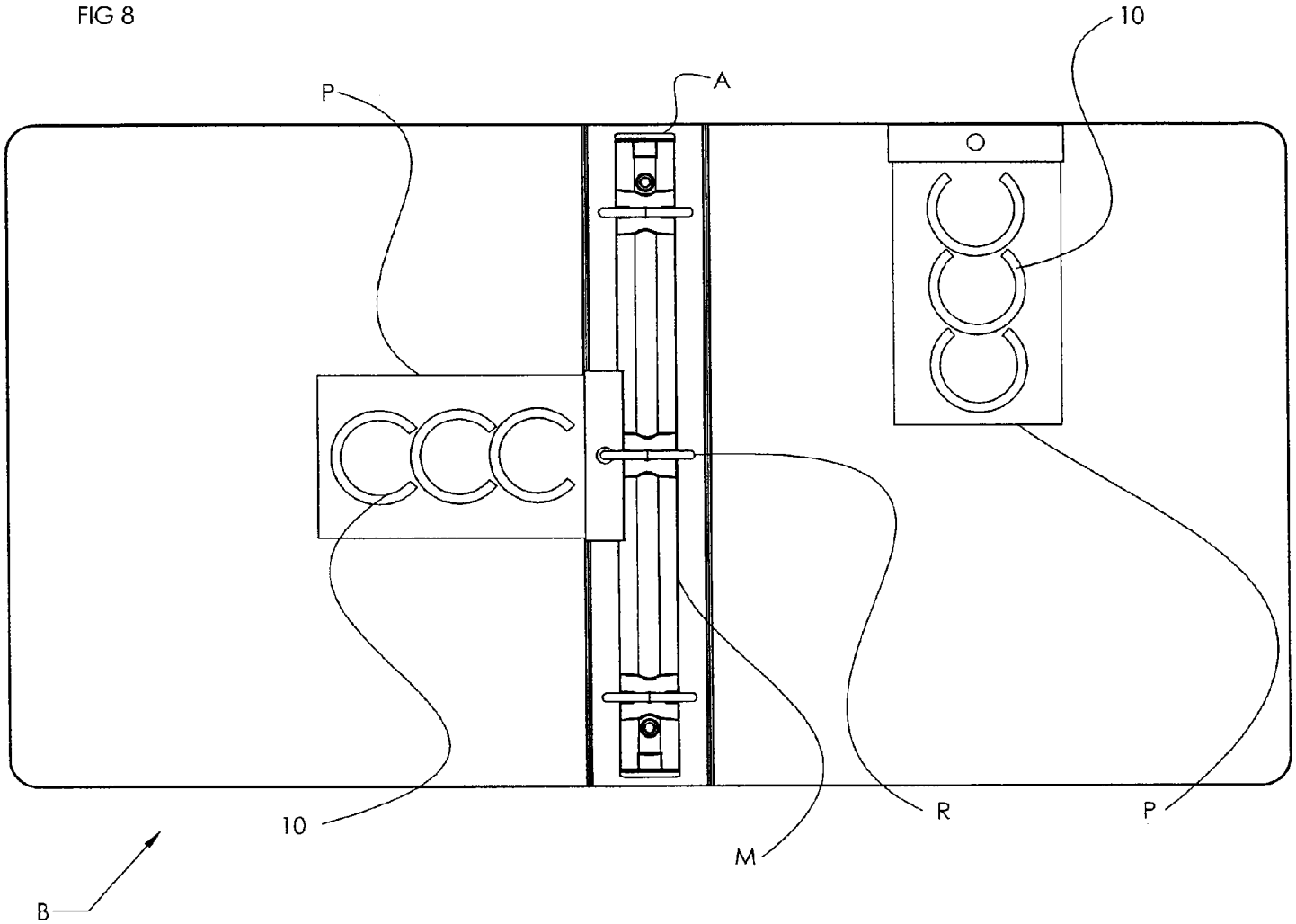
FIG. 8 illustrates a binder ring cover to which a packet of ring guards is attached for sale and use with a binder.
Figure 10:
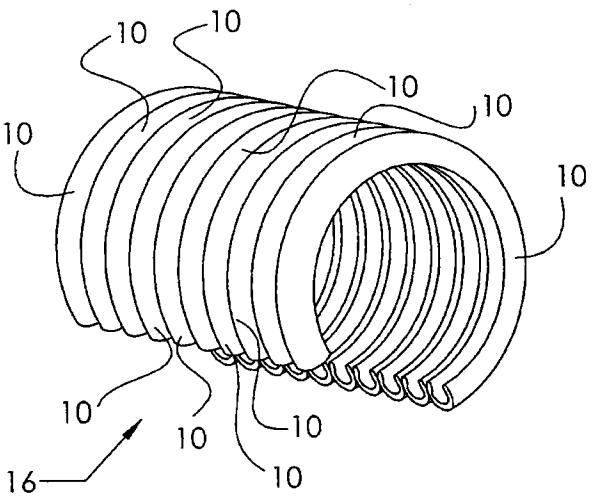
FIG. 10 is a perspective view of a coiled strip arrangement of ring guards in which a user pulls apart a ring guard from one end of the coil for use in a binder.
Figure 9:
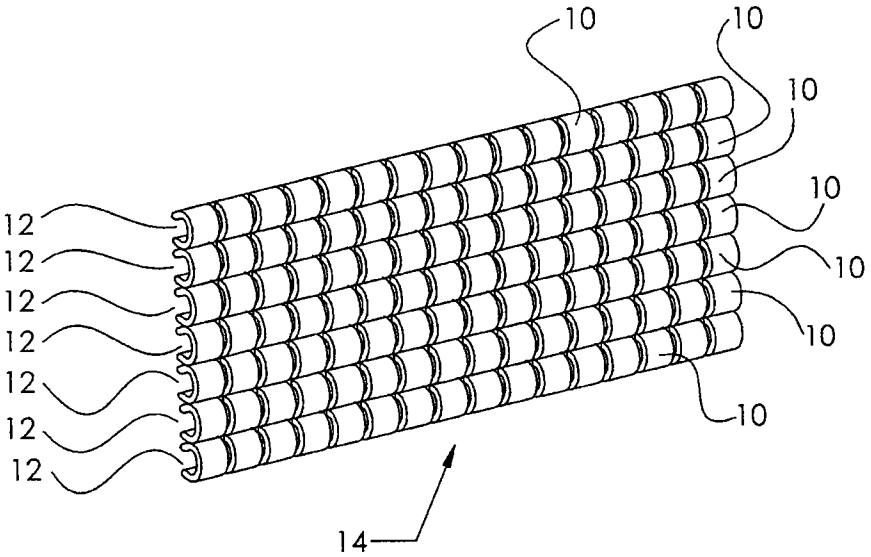
FIG. 9 is a perspective view of a side-by-side strip arrangement of ring guards in which a user pulls apart a ring guard for use in a binder.

Referring to FIGS. 8-10, the ring guards can be provided in different ways. As previously discussed, the guard rings can be installed on one or more of the binder rings R during manufacturing or packaging of binders B. Alternately, one of more of the ring guards is enclosed in a package P which is attached to a cover C of binder B, or to one of the binder rings R. This is as shown in FIG. 8.

Alternately, and as shown in FIG. 9, a number of ring guards 10 can be conjoined into a strip 14 of ring guards. Now when a ring guard is needed, a user simply peels one off of the end of the strip for use. Besides the strip arrangement, the ring guards can be made into a coil 16 arrangement as shown in FIG. 10. Now when a ring guard is needed, the user simply detaches one from the end of the strip. Those skilled in the art will understand that while the packaging arrangements shown in FIGS. 8-10 are for ring guards 10, these arrangements can also be used with ring guards 20 and 30.

Figure 11B:
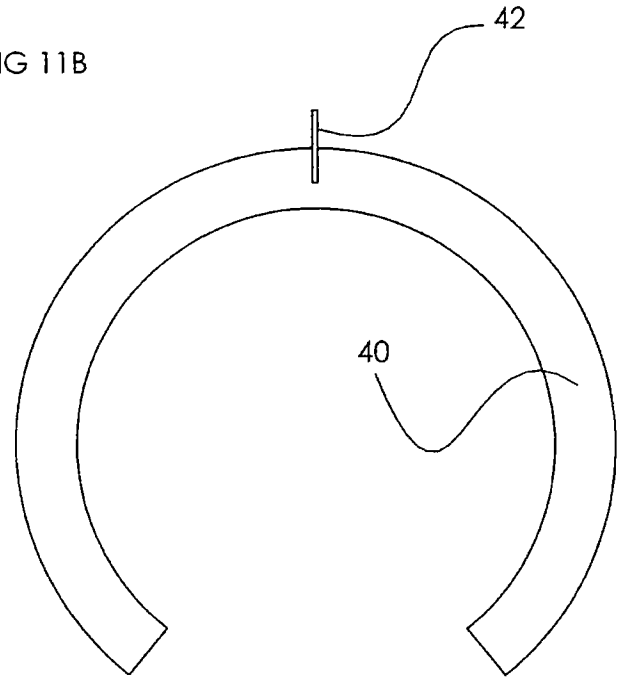
FIGS. 11A and 11B illustrate another embodiment of the ring guard in which a tab projects from the outer surface of the ring guard to assist in installation and removal of the ring guard from a binder ring.
Figure 11A:
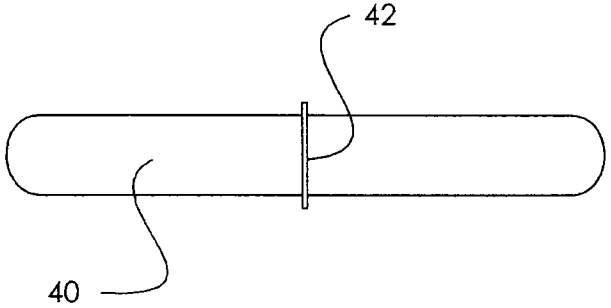
Figure 12B:
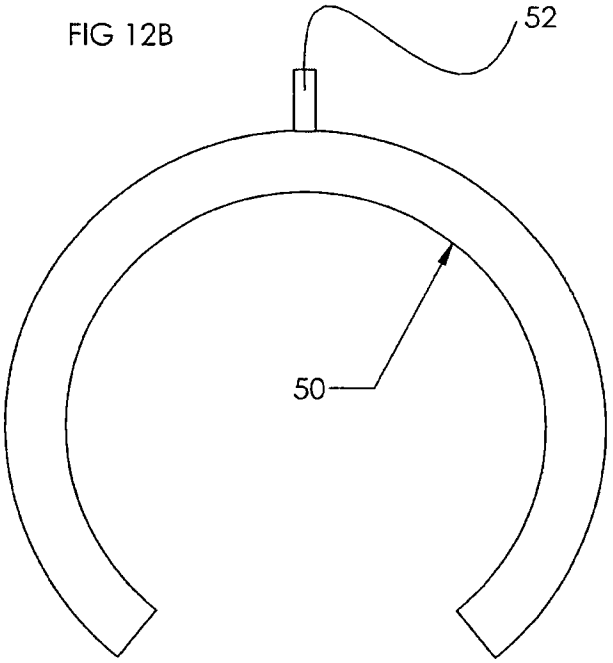
FIGS. 12A and 12B illustrate yet another embodiment of the ring guard in which a post shaped tab projects from the outer surface of the ring guard to assist in installation and removal of the ring guard from a binder ring.
Figure 12A:
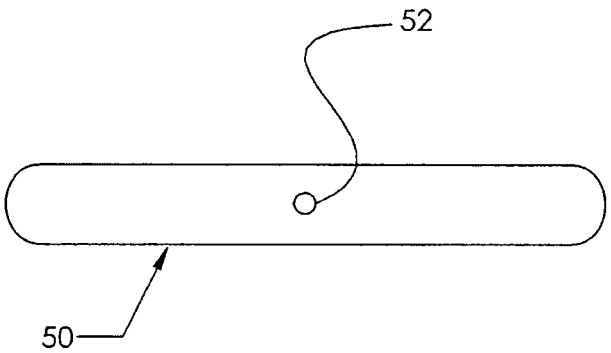

Referring next to FIGS. 11 A, 11 B, 12A, and 12B, additional embodiments of the ring guards include a tab formed on the outer surface of the ring guard approximately midway along its length and positioned over the junction between the ring halves. The tab extends outwardly from the outer surface of the ring guard. In FIGS. 11A and 11B, a ring guard 40 includes a tab 42 extending transversely of a longitudinal axis of the ring guard. Tab 42 is useful in that a user installs or removes the ring guard from a binder ring by grasping the tab to push the ring guard onto the binder ring or pull it off of the binder ring. In FIGS. 12A and 12B, a ring guard 50 includes a post shaped tab 52. Again, tab 52 is useful for installing or removing the ring guard from a binder ring by grasping the tab to push the ring guard onto the binder ring or subsequently pull it off of the binder ring. In both embodiments, the tab is a thin tab that does not interfere with the contents stored in the binder. In some instances, the tab can be used as a place marker denoting where some particular material is located in the binder.

Figure 13C:
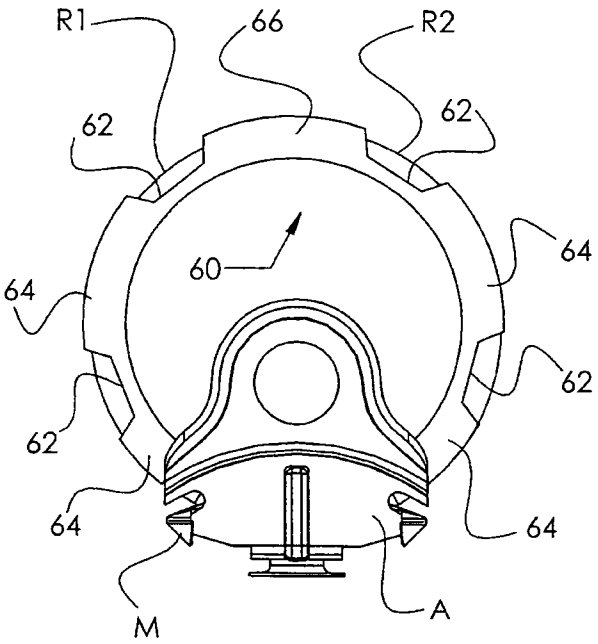
Figure 13A:
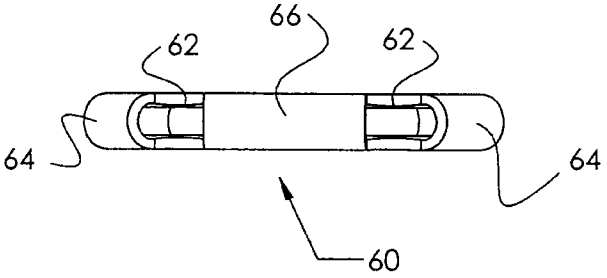
Figure 13B:
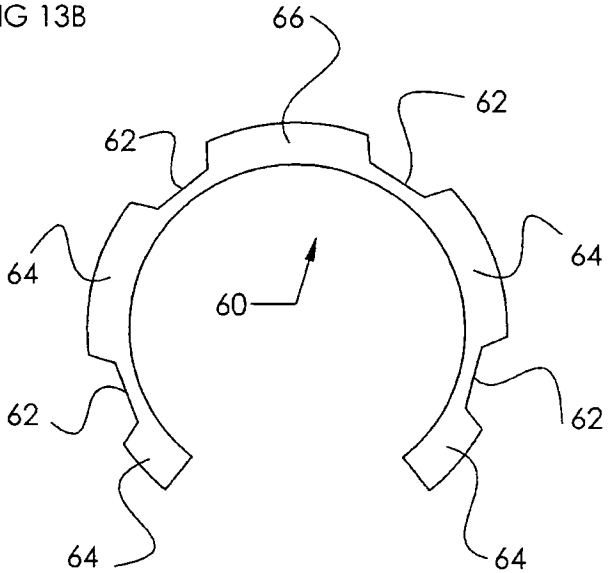

FIGS. 13A-13C illustrate another embodiment of the invention. In this embodiment, a ring guard 60 has longitudinal slots 62 formed intermediate respective end sections 64 of the ring guard, and a middle, or center, section 66. When installed on a binder ring, middle section 66 encompasses the junction J where the outer, mating ends of ring halves R1, R2 meet. The respective end sections 64 each encompasses a portion of the respective ring halves adjacent the other end of each ring half. The slotted ring guard 60 requires less material to manufacture while still providing the benefits previously discussed. The length of center section 66 of ring guard 60 is sufficient that if the binder in which the ring guard is used is dropped or otherwise subjected to a force, any momentary separation of the mating ends of the ring halves are still enclosed within this section. Those skilled in the art will understand that the length and width of the slots 62 can be greater of lesser than as shown in the drawings, that more than one slot can be formed between each end section 64 and middle section 66, and that the slots do not have to be rectangular slots but could, for example, have rounded ends. It will further be appreciated by those skilled in the art that similar embodiments of ring guard 60 can be made for ring guard shapes similar to those of ring guards 20 and 30.

Figure 14C:
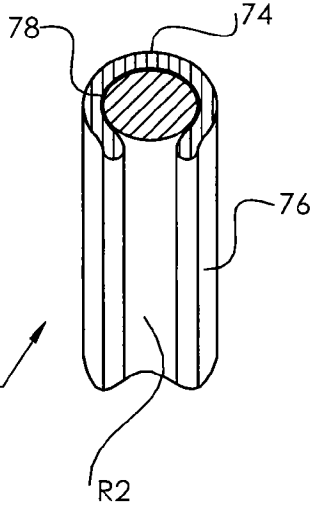
FIGS. 14A-14C illustrate an embodiment for a ring guard installed on a D-type binder ring; and, FIG. 15 is a perspective view illustrating a further embodiment of the ring guard comprising a two-piece snap together construction.
Figure 14B:
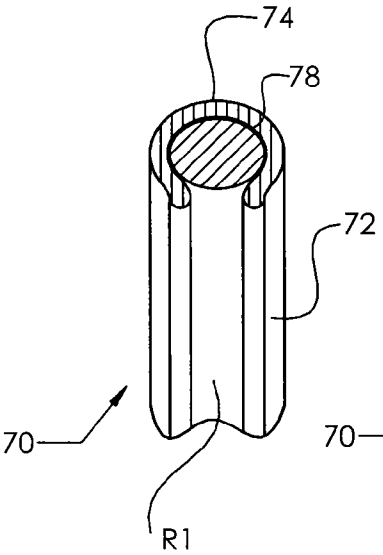
Figure 14A:
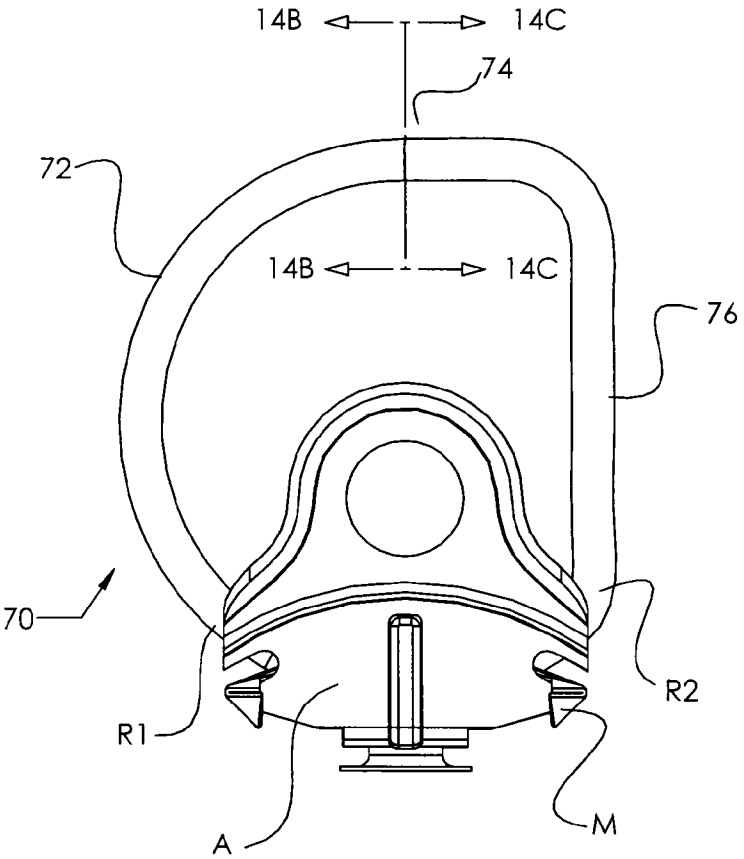

Referring to FIGS. 14A-14C, a ring guard 70 is for use on a D-type binder ring such as shown in FIG. 3C. Ring guard 70 includes a generally rounded section 72 which fits over the rounded contour of ring half R1. At the upper end of this ring half, ring guard 70 has a somewhat flatter section 74 which encompasses the outer end of ring half R1, the junction between ring halves R1 and R2, and the outer end of ring half R2. Finally, ring guard 70 has a generally straight section 76 which angles outwardly from the upper toward the lower end of ring half R2. Ring guard 70 also has a channel 78 (see FIGS. 14B and 14C) extending lengthwise of the ring guard for fitting ring guard 70 about the top and sides of the ring halves in the same manner as previously discussed. FIGS. 14B and 14C are respective sectional views of ring guard 70 showing its installation about the respective ring halves R1, R2.

As with ring guards 10, 20, and 30 previously described, ring guard 70 has an outer circumference greater than 180° so to cover more than one-half the outer circumference of each ring half; and, as with the previously described embodiments, this outer circumference is preferably between 240°-270°. Because of the overall D-shape of this type binder ring, once installed, ring guard 70 cannot move in either direction about the binder ring.

Figure 15:
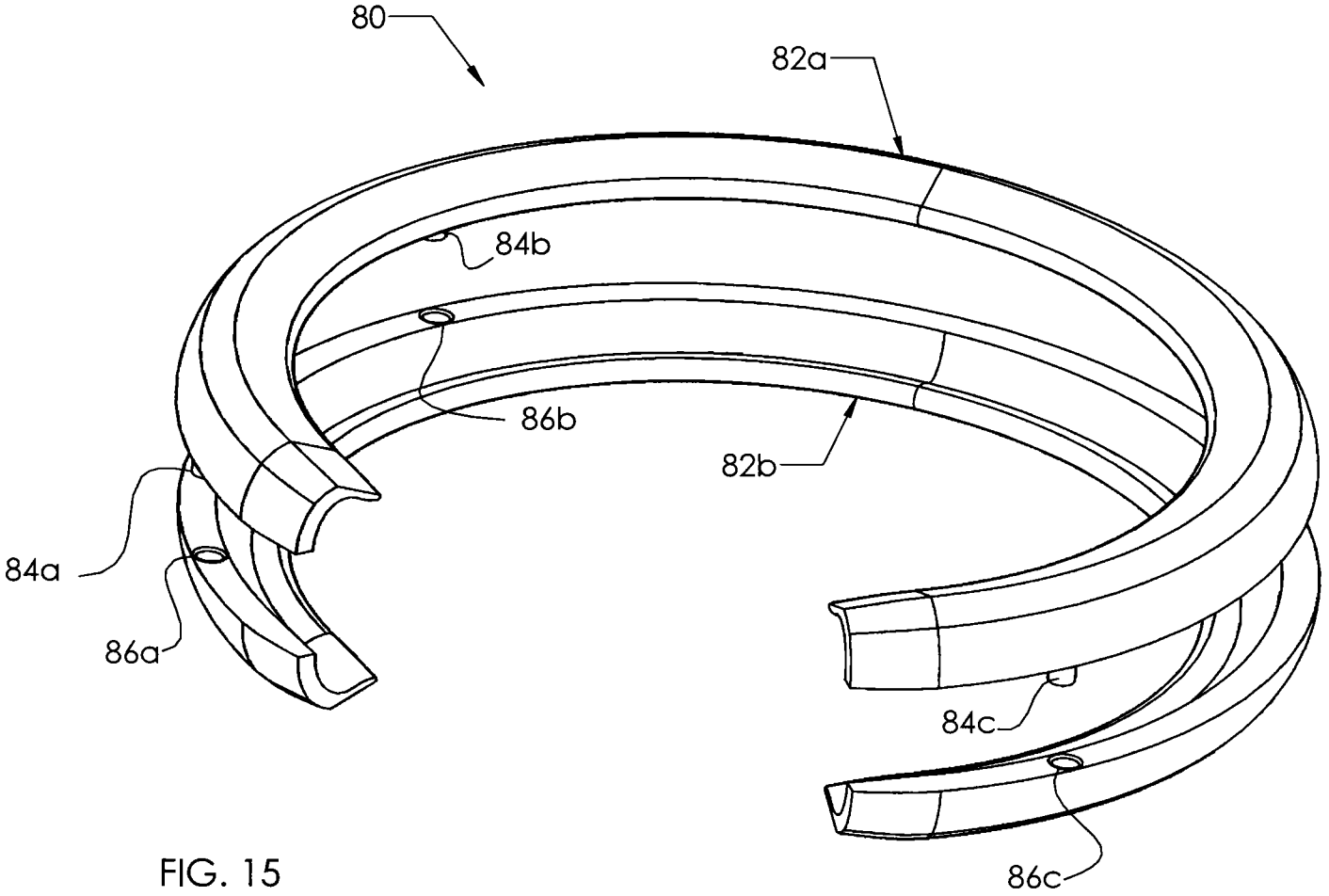

Referring now to FIG. 15, a ring guard 80 is comprised of two complementary ring guard halves 82*a*, 82*b*. Ring guard half 82*a* has a series of posts 84*a*-84*c* generally equidistantly spaced about an inner face of the ring guard half. Ring guard half 82*b* has a series of holes 86*a*-86*c* correspondingly located about its inner face. Those skilled in the art will understand that there could be more, or fewer, posts and holes located about the respective ring guard halves than as is shown in FIG. 15. Prior to installing ring guard 80 on a binder ring, the two ring guard halves are fitted together by fitting the posts 84*a*-84*c* on ring guard half 82*a* into the corresponding holes 86*a*-86*c* on ring guard half 82*b*.

Those skilled in the will understand that while the construction shown in FIG. 15 is similar to the ring guard 10 previously described, similar construction can be made for the previously described ring guards 20 and 30. Ring guard 80 includes similar features to the ring guards previously described. In particular, as with these previously described ring guards, when ring guard 80 is assembled, its over outer circumference greater than 180° so to cover more than one-half the outer circumference of each ring half; and, as with the previously described embodiments, this outer circumference is preferably between 240°-270°.

A feature of ring guard 80 is that, as noted above, the ring guards are available in a variety of colors. With ring guard 80, it is possible to put together a ring guard in which one-half is one color and the other half a different color.

What has been described is a variety of ring guards for installation on one or more binder rings of a ring metal, the binder rings being of one of a number of differently shaped configurations. When installed, the ring guard retains each binder ring in a closed, no gap or "gap free" configuration which persists even if the mating ends of the binder ring segments momentarily move apart due to some force being applied to the binder such as when it falls from a height or something slams into the binder. The ring guards are of a one-piece construction and are made of a material that is sufficiently flexible to allow a ring guard to be readily installed about the ring halves which comprise a binder ring. However, once installed, the ring guard fits snuggly about each ring half so as not to be dislodged if the binder in which it is installed is dropped or otherwise struck with a sharp force.

In view of the above, it will be seen that the several objects and advantages of the present disclosure have been achieved and other advantageous results have been obtained.

Having thus described the invention, what is claimed and desired to be secured by Letters Patent is:

1. In a binder ring metal holding hole punched sheets of material, the ring metal including at least one binder ring formed by a pair of binder ring halves, and movable frames to which one end of each ring half is attached for movement of the frames to open and close the binder ring, the improvement comprising:

a ring guard removably installable over the binder ring, when the binder ring is closed, and covering at least a portion of each ring half including a junction where outer ends of the ring halves meet when the binder ring is closed, the ring guard securely gripping the binder ring and preventing a gap from opening between the ring halves when the binder is subjected to a force which would otherwise cause a gap to form between the outer ends of the ring halves and the material stored in the binder to spill out or be damaged; and, the ring guard being comprised of two complementary ring guard halves one of which has a series of posts generally equidistantly spaced about an inner face of the ring guard half and the other ring guard half having a series of holes correspondingly located about its inner face for assembly of the ring guard by installing the posts in the one ring guard half into the holes in the other ring guard half.

2. The improvement of claim 1 in which a binder has a plurality of binder rings and a separate ring guard is installed on each ring.

3. The improvement of claim 1 in which an outer circumference of the ring guard is between 240°-270° so to substantially cover an outer surface of the ring halves and not pull away from, or fall off, the binder ring during usage of the binder.

4. In a binder ring metal holding hole punched sheets of paper, the ring metal including a plurality of binder rings each of which is formed by a pair of binder ring halves, and movable frames to which one end of each ring half is attached for movement of the frames to open and close the binder rings, the improvement comprising:

a ring guard removably installable over each binder ring, when the binder rings are closed, and covering at least a portion of each ring half of each binder ring including a junction where outer ends of the ring halves for the respective binder rings meet when the binder is closed, each ring guard securely gripping its associated binder ring and preventing a gap from opening between the ring halves of the binder ring when the binder is subjected to a force which would otherwise cause a gap to form between the outer ends of the ring halves of a binder ring and the paper stored in the binder to spill out or be damaged; and each ring guard being comprised of two complementary ring guard halves one of which has a series of posts generally equidistantly spaced about an inner face of the ring guard half and the other ring guard half having a series of holes correspondingly located about its inner face for assembly of the ring guard by installing the posts in the one ring guard half into the holes in the other ring guard half.

5. The improvement of claim 4 in which an outer circumference of each ring guard is between 240°-270° so to substantially cover an outer surface of the ring halves and not pull away from, or fall off, the binder ring during usage of the binder.

* * * * *